US008968556B2

(12) United States Patent
Kift et al.

(10) Patent No.: US 8,968,556 B2
(45) Date of Patent: Mar. 3, 2015

(54) PROCESS FOR EXTRACTING BITUMEN AND DRYING THE TAILINGS

(75) Inventors: Julian Kift, Reno, NV (US); Mahendra Joshi, Katy, TX (US); Cherish M. Hoffman, Reno, NV (US); Whip C. Thompson, Reno, NV (US)

(73) Assignee: Shell Canada Energy Cheveron Canada Limited, Calgary (CA)

( * ) Notice: Subject to any disclaimer, the term of this patent is extended or adjusted under 35 U.S.C. 154(b) by 133 days.

(21) Appl. No.: 13/273,975

(22) Filed: Oct. 14, 2011

(65) Prior Publication Data

US 2012/0145603 A1 Jun. 14, 2012

Related U.S. Application Data

(63) Continuation-in-part of application No. 12/964,612, filed on Dec. 9, 2010.

(51) Int. Cl.
*C10G 1/04* (2006.01)

(52) U.S. Cl.
USPC ..... 208/390; 208/391

(58) Field of Classification Search
USPC ..... 208/390–391
See application file for complete search history.

(56) References Cited

U.S. PATENT DOCUMENTS

| | | | | |
|---|---|---|---|---|
| 2,871,180 | A | 1/1959 | Lowman et al. | |
| 3,131,141 | A | 4/1964 | West | |
| 3,484,365 | A | 12/1969 | Pitchford | |
| 3,527,692 | A | 9/1970 | Titus | |
| 3,565,593 | A | 2/1971 | Moore et al. | |
| 3,565,594 | A | 2/1971 | Moore | |
| 3,779,902 | A | 12/1973 | Mitchell et al. | |
| 4,035,282 | A | 7/1977 | Stuchberry et al. | |
| 4,046,668 | A | 9/1977 | Farcasiu et al. | |
| 4,054,506 | A | 10/1977 | Hart, Jr. et al. | |
| 4,120,773 | A | 10/1978 | Ridgway | |
| 4,120,777 | A | 10/1978 | Globus | |
| 4,139,450 | A | 2/1979 | Hanson et al. | |
| 4,222,873 | A | 9/1980 | Parsons | |
| 4,224,138 | A | 9/1980 | Kruyer | |
| 4,250,016 | A | 2/1981 | Estes et al. | |
| 4,308,133 | A | 12/1981 | Meyer | |
| 4,347,118 | A * | 8/1982 | Funk et al. | 208/390 |
| 4,490,259 | A | 12/1984 | Coffing | |
| 4,512,872 | A | 4/1985 | Chung et al. | |
| 4,589,980 | A | 5/1986 | Keys | |

(Continued)

FOREIGN PATENT DOCUMENTS

| | | |
|---|---|---|
| CA | 2224615 | 6/1999 |
| WO | WO 2007/102819 | 9/2007 |
| WO | WO 2011/082209 | 7/2011 |

OTHER PUBLICATIONS

Information about Related Patents and Patent Applications, see the section below having the same title.

(Continued)

*Primary Examiner* — Randy Boyer
*Assistant Examiner* — Juan Valencia

(57) ABSTRACT

A process for separating bitumen from bitumen ore material includes extracting bitumen with a hydrocarbon solvent to produce a bitumen-enriched solvent phase and tailings. The tailings are dried or stripped in a dryer to remove any remaining hydrocarbon solvent. The amount of solvent discharged in the tailings may be less than 4 bbl per 1000 bbl of recovered bitumen.

18 Claims, 5 Drawing Sheets

(56) References Cited

U.S. PATENT DOCUMENTS

| | | | | |
|---|---|---|---|---|
| 4,592,826 | A | 6/1986 | Ganguli | |
| 4,596,651 | A | 6/1986 | Wolff et al. | |
| 4,612,113 | A | 9/1986 | Kallioinen | |
| 4,676,889 | A | 6/1987 | Hsieh et al. | |
| 4,678,561 | A | 7/1987 | Keys | |
| 4,678,562 | A | 7/1987 | Keys | |
| 4,702,487 | A | 10/1987 | Stoian et al. | |
| 4,722,782 | A | 2/1988 | Graham et al. | |
| 4,724,272 | A | 2/1988 | Raniere et al. | |
| 4,744,890 | A | 5/1988 | Miller et al. | |
| 4,846,964 | A | 7/1989 | Scott et al. | |
| 4,859,317 | A | 8/1989 | Shelfantook et al. | |
| 5,044,552 | A | 9/1991 | Becker et al. | |
| 5,084,160 | A | 1/1992 | Stewart et al. | |
| 5,143,598 | A | 9/1992 | Graham et al. | |
| 5,176,802 | A | 1/1993 | Duyvesteyn et al. | |
| 5,223,148 | A | 6/1993 | Tipman et al. | |
| 5,236,577 | A | 8/1993 | Tipman et al. | |
| 5,295,665 | A | 3/1994 | Mackie | |
| 5,389,274 | A | 2/1995 | Fernandez | |
| 5,443,158 | A | 8/1995 | McKenny et al. | |
| 5,485,883 | A | 1/1996 | Rippetoe et al. | |
| 5,520,799 | A | 5/1996 | Brown et al. | |
| 5,534,136 | A | 7/1996 | Rosenbloom | |
| 5,538,081 | A | 7/1996 | Rippetoe et al. | |
| 5,554,301 | A | 9/1996 | Rippetoe et al. | |
| 5,626,743 | A | 5/1997 | Humphreys | |
| 5,626,793 | A | 5/1997 | Reiffenrath et al. | |
| 5,670,056 | A | 9/1997 | Yoon et al. | |
| 5,670,345 | A | 9/1997 | Srivastava et al. | |
| 5,702,612 | A | 12/1997 | Wang | |
| 5,728,202 | A | 3/1998 | Nelson et al. | |
| 5,795,466 | A | 8/1998 | Kelebek et al. | |
| 5,798,137 | A | 8/1998 | Lord et al. | |
| 5,849,201 | A | 12/1998 | Bradley | |
| 5,872,289 | A | 2/1999 | Appleby et al. | |
| 5,876,592 | A | 3/1999 | Tipman et al. | |
| 5,896,435 | A | 4/1999 | Gautier et al. | |
| 5,961,786 | A | 10/1999 | Freel et al. | |
| 5,968,349 | A | 10/1999 | Duyvesteyn et al. | |
| 5,992,050 | A * | 11/1999 | Kemper et al. | 34/588 |
| 6,007,709 | A | 12/1999 | Duyvesteyn et al. | |
| 6,036,849 | A | 3/2000 | Rippetoe et al. | |
| 6,074,558 | A | 6/2000 | Duyvesteyn et al. | |
| 6,106,787 | A | 8/2000 | Rippetoe | |
| 6,214,213 | B1 | 4/2001 | Tipman et al. | |
| 6,320,148 | B1 | 11/2001 | Yoon et al. | |
| 6,352,639 | B2 | 3/2002 | Ito et al. | |
| 6,427,843 | B1 | 8/2002 | Clark | |
| 6,514,310 | B2 | 2/2003 | Allemand et al. | |
| 6,589,417 | B2 | 7/2003 | Taciuk et al. | |
| 6,595,163 | B2 | 7/2003 | Dumaz et al. | |
| 6,764,542 | B1 | 7/2004 | Lackey et al. | |
| 6,768,015 | B1 | 7/2004 | Luxem et al. | |
| 6,793,079 | B2 | 9/2004 | Khan et al. | |
| 6,822,105 | B1 | 11/2004 | Luxem et al. | |
| 6,827,786 | B2 | 12/2004 | Lord | |
| 6,827,841 | B2 | 12/2004 | Kiser et al. | |
| 6,871,743 | B2 | 3/2005 | Yoon et al. | |
| 6,936,227 | B1 | 8/2005 | De Souze et al. | |
| 6,965,044 | B1 | 11/2005 | Hammond et al. | |
| 6,989,091 | B2 | 1/2006 | Jorgensen | |
| 7,008,528 | B2 | 3/2006 | Mitchell et al. | |
| 7,011,749 | B2 | 3/2006 | Hayes et al. | |
| 7,018,435 | B1 | 3/2006 | Wentinck | |
| 7,097,675 | B2 | 8/2006 | Detering et al. | |
| 7,384,557 | B2 | 6/2008 | Phillips et al. | |
| 7,438,807 | B2 | 10/2008 | Garner et al. | |
| 7,464,756 | B2 | 12/2008 | Gates et al. | |
| 7,585,407 | B2 | 9/2009 | Duyvesteyn | |
| 7,588,682 | B2 | 9/2009 | Norman | |
| 7,618,597 | B2 | 11/2009 | Duyvesteyn | |
| 7,811,444 | B2 | 10/2010 | Duyvesteyn et al. | |
| 7,824,453 | B2 | 11/2010 | Duyvesteyn | |
| 7,909,989 | B2 | 3/2011 | Duyvesteyn et al. | |
| 7,985,333 | B2 | 7/2011 | Duyvesteyn | |
| 8,101,067 | B2 | 1/2012 | Duyvesteyn et al. | |
| 8,257,580 | B2 | 9/2012 | Duyvesteyn et al. | |
| 2005/0070218 | A1 | 3/2005 | Phillips et al. | |
| 2007/0170095 | A1 | 7/2007 | Freel et al. | |
| 2008/0156702 | A1 | 7/2008 | Duyvesteyn | |
| 2008/0242875 | A1 | 10/2008 | Hong et al. | |
| 2009/0090654 | A1 | 4/2009 | Duyvesteyn et al. | |
| 2009/0145809 | A1 | 6/2009 | Ledbetter et al. | |
| 2009/0294332 | A1 * | 12/2009 | Ryu | 208/390 |
| 2009/0301937 | A1 * | 12/2009 | Duyvesteyn et al. | 208/390 |
| 2010/0032348 | A1 | 2/2010 | Duyvesteyn et al. | |
| 2011/0017642 | A1 | 1/2011 | Duyvesteyn | |
| 2011/0062057 | A1 | 3/2011 | Duyvesteyn | |
| 2011/0155648 | A1 | 6/2011 | Duyvesteyn et al. | |
| 2011/0180458 | A1 | 7/2011 | Duyvesteyn et al. | |
| 2011/0180459 | A1 | 7/2011 | Duyvesteyn et al. | |
| 2012/0145602 | A1 | 6/2012 | Kift et al. | |
| 2012/0145603 | A1 | 6/2012 | Kift et al. | |
| 2012/0152809 | A1 | 6/2012 | Kift et al. | |
| 2012/0228196 | A1 | 9/2012 | Kift et al. | |
| 2012/0305452 | A1 | 12/2012 | Duyvesteyn et al. | |
| 2013/0006026 | A1 | 1/2013 | Kift et al. | |
| 2013/0025861 | A1 | 1/2013 | Kift et al. | |
| 2013/0026076 | A1 | 1/2013 | Kift et al. | |
| 2013/0026077 | A1 | 1/2013 | Joshi et al. | |
| 2013/0026078 | A1 | 1/2013 | Joshi et al. | |

OTHER PUBLICATIONS

U.S. Appl. No. 13/584,333, filed Aug. 13, 2012, Methods and Systems for In-Situ Extraction of Bitumen.

U.S. Appl. No. 13/584,432, filed Aug. 13, 2012, Process for Extracting Bitumen and Drying the Tailings.

U.S. Appl. No. 13/584,677, filed Aug. 13, 2012, Dry, Stackable Tailings and Methods for Producing the Same.

U.S. Appl. No. 13/593,045, filed Aug. 23, 2012, Methods and Systems for Upgrading Hydrocarbon.

U.S. Appl. No. 13/559,124, filed Jul. 26, 2012, Methods for Extracting Bitumen from Bituminous Material.

U.S. Appl. No. 13/558,041, filed Jul. 25, 2012, Methods and Apparatus for Bitumen Extraction.

U.S. Appl. No. 13/557,842, filed Jul. 25, 2012, Methods and Systems for In-Situ Extraction of Bitumen.

U.S. Appl. No. 13/557,503, filed Jul. 25, 2012, Methods for Obtaining Bitumen from Bituminous Materials.

U.S. Appl. No. 13/524,303, filed Jun. 15, 2012, Methods of Transporting Various Bitumen Extraction Products and Compositions Thereof.

Acetone MSDS, Sigma-Aldrich, Apr. 19, 2012 (8 pp.).

Benzene MSDS, Sigma-Aldrich, Apr. 27, 2012 (9 pp.).

Flores III, Heavy Oil Upgrading, Technology Today, Spring 2010 (6 pp.).

Toluene MSDS, Sigma-Aldrich, Apr. 24, 2012 (8 pp.).

U.S. Appl. No. 13/558,041, filed Jul, 25, 2012, Methods and Apparatus for Bitumen Extraction.

U.S. Appl. No. 13/418,044, filed Mar. 12, 2012, Methods of Preparing Bituminous Material for Bitumen Extraction.

U.S. Appl. No. 13/273,975, filed Oct. 14, 2011, Process for Extracting Bitumen and Drying the Tailings.

Sinnott, R. K., Chemical Engineering Design, vol. 6, 4th ed., p. 402, Elsevier, 2005 (2 pp.).

Campbell, National Biodiesel Board 2005 Annual Meeting, Marina Marriott, Ft. Lauderdale, FL, Feb. 1, 2005 (9 pp.).

Cohen et al., "Degradation of Coal by Fungi Polyporus Versicolor and Poria Monticola," Appl. Enviorn. Microbiol., 44(1):23-27, Jul. 1982 (5 pp.).

Desolventizer-Toaster, Crown Iron Works Company, PDF file created Feb. 16, 2010, (3 pp.).

Gallmetzer et al., "Efflux of Organic Acids in Penicillium Simplicissimum is an Energy-Spilling Porcess . . . ," Microbiology 148:1143-1149, 2002 (7 pp.).

Hong et al., "A Polar-Nonpolar, Acetic Acid/Heptane, Solvent Medium for Degradation of Pyrene by Ozone," Ind. Eng. Chem. Res. 43:7710-7715, 2004 (6 pp.).

(56) References Cited

OTHER PUBLICATIONS

Houdaille, "Jet Pump Techinical Data—Puming Liquids," pp. 1-11, 1982 (12 pp.).
International Search Report, PCT/US2010/62133, Aug. 30, 2011 (3 pp.).
International Search Report, PCT/US10/43822, Nov. 29, 2010 (4 pp.).
International Search Report, PCT/US10/43082, Sep. 14, 2010 (11 pp.).
International Search Report and Written Opinion, PCT/US09/35552, Apr. 17, 2009 (8 pp.).
International Search Report and Written Opinion, PCT/US07/19222, Apr. 28, 2008 (8 pp.).
International Search Report, PCT/US2005/34092, Jul. 26, 2007 (6 pp.).
International Search Report, PCT/US2006/08263, Oct. 23, 2006 (5 pp.).
International Search Report, PCT/US2005/36728, Aug. 8, 2005 (8 pp.).
Lewis, "Liquefied Petroleum Gas," Hawley's condensed Chemical Dictionary (14th Edition), John Wiley Sons. , 2002 (1 p.).
Rogoff et al., "The Microbiology of Coal," Bureau of Mines, U.S. Dept. of the Interior, Region V, Bruceton, PA, 73:264-268, Aug. 23, 1956 (5 pp.).
Soygold, Environmental Solutions to Your Market Challenges, http://www.soygold.com/applications.htm, printed Mar. 6, 2007 (2 pp.).
Vicente et al., "A Comparative Study of Vegetable Oils for Biodiesel Production in Spain," Energy & Fuels, 20:394-398, 2006 (published on Web Nov. 8, 2005) (5 pp.).
U.S. Appl. No. 12/964,612, filed Dec. 9, 2010, Process for Extracting Bitumen and Drying the Tailings.
U.S. Appl. No. 12/956,701, filed Nov. 30, 2010, Methods for Extracting Bitumen from Bituminous Materials.
U.S. Appl. No. 12/692,127, filed Jan. 22, 2010, Methods fro Extracting Bitumen from Bituminous Material.

* cited by examiner

PROCESS FOR EXTRACTING BITUMEN AND DRYING THE TAILINGS

CROSS-REFERENCE TO RELATED PATENT APPLICATIONS

This application is a continuation-in-part of U.S. application Ser. No. 12/964,612, filed Dec. 9, 2010, the entirety of which is hereby incorporated by reference. The entire contents of the following documents are also incorporated by reference herein. U.S. Prov. App. No. 60/617,739, entitled "Method for Obtaining Bitumen from Tar Sands," filed on 13 Oct. 2004; U.S. patent application Ser. No. 11/249,234, entitled "Method for Obtaining Bitumen from Tar Sands," filed on 12 Oct. 2005, published as U.S. Pat. App. Pub. No. 2006/0076274; U.S. patent application Ser. No. 12/041,554, entitled "System and Method of Separating Bitumen from Tar Sands," filed on 3 Mar. 2008, published as U.S. Pat. App. Pub. No. 2008/0210602; U.S. patent application Ser. No. 12/512,758, entitled "Dry, Stackable Tailings and Methods for Producing the Same," filed on 30 Jul. 2009, published as U.S. Pat. App. Pub. No. 2009/0301937; U.S. patent application Ser. No. 12/509,298, entitled "System and Method for Converting Material Comprising Bitumen into. Light Hydrocarbon Liquid Product," filed on 24 Jul. 2009; U.S. patent application Ser. No. 12/560,964, entitled "Methods for Obtaining Bitumen from Bituminous Materials," filed on 16 Sep. 2009; U.S. patent application Ser. No. 12/648,164, entitled "Methods for Obtaining Bitumen from Bituminous Materials," filed on 28 Dec. 2009; U.S. patent application Ser. No. 12/692,127, entitled "Methods for Extracting Bitumen from Bituminous Material," filed on 22 Jan. 2010. In the event of a conflict, the subject matter explicitly recited or shown herein controls over any subject matter incorporated by reference. The incorporated subject matter should not be used to limit or narrow the scope of the explicitly recited or depicted subject matter.

BACKGROUND

Bitumen is a heavy type of crude oil that is often found in naturally occurring geological materials such as tar sands, black shales, coal formations, and weathered hydrocarbon formations contained in sandstones and carbonates. Bitumen may be described as a flammable brown or black mixture of tarlike hydrocarbons derived naturally or by distillation from petroleum. Bitumen can be in the form of a viscous oil to a brittle solid, including asphalt, tars, and natural mineral waxes. Bitumen is often referred to in the industry as a naturally occurring viscous mixture, composed mainly of hydrocarbons heavier than pentane (may contain sulfur compounds), and in its naturally occurring viscous state will not flow to a well.

Substances that include bitumen may be referred to as bituminous, e.g., bituminous coal, bituminous tar, or bituminous pitch. At room temperature, the flowability of bitumen is much like cold molasses. Bitumen may be processed to yield oil and other commercially useful products, primarily by cracking the bitumen into lighter hydrocarbon material.

As noted above, tar sands represent one well known source of bitumen. Tar sands typically include bitumen, water, and mineral solids. The mineral solids may include inorganic solids such as coal, sand, and clay. Tar sand deposits can be found in many parts of the world, including North America. One of the largest North American tar sands deposits is in the Athabasca region of Alberta, Canada. In the Athabasca region, the tar sands formation can be found at the surface, although it may also be buried two thousand feet below the surface overburden or more.

Tar sands deposits can be measured in barrels of equivalent oil. It is estimated that the Athabasca tar sands deposit contains the equivalent of about 1.7 to 2.3 trillion barrels of, oil. Global tar sands deposits have been estimated to contain up to 4 trillion barrels of oil. By way of comparison, the proven worldwide oil reserves are estimated to be about 1.3 trillion barrels.

The bitumen content of tar sands may vary from approximately 3 wt % to 21 wt %, with a typical content of approximately 12 wt %. The remainder is water and mineral matter such as sand and clay.

The first step in deriving oil and other commercially useful products from bitumen is to separate the bitumen from the carrier material. In the case of tar sands, this may include separating the bitumen from the mineral solids and other components in the tar sands.

One method for extracting bitumen from tar sands is with a hydrocarbon solvent. The solvent is mixed with tar sand and dissolves the bitumen. The solvent phase is separated from mineral matter and other materials, which form the tailings. In this way, the process can successfully extract most of the bitumen from the tar sands.

One of the challenges associated with using a hydrocarbon solvent is separating the solvent from the tailings. Many government authorities severely limit the amount of hydrocarbon solvent that can be discharged with the tailings. Meeting this requirement can be difficult.

SUMMARY

Disclosed below are representative embodiments that are not intended to be limiting in any way. Instead, the present disclosure is directed toward novel and nonobvious features, aspects, and equivalents of the embodiments of the methods described below. The disclosed features and aspects of the embodiments can be used alone or in various novel and nonobvious combinations and sub-combinations with one another.

A number of embodiments of a process for separating bitumen from bitumen ore material are described herein. At a high level, the process includes extracting bitumen with a hydrocarbon solvent to produce a bitumen-enriched solvent phase and tailings. The tailings are dried or stripped in a dryer to remove any remaining hydrocarbon solvent. The amount of solvent discharged in the tailings may be less than 4 bbl per 1000 bbl of recovered bitumen.

The bitumen ore material may be any material from which bitumen can be successfully extracted. In one embodiment, the bitumen ore material includes tar sands such as those found in the Athabasca region in Canada. In other embodiments, the material may include oil shale, bituminous coal, and/or other similar materials.

The solvent extraction portion of the process may have any of a number of suitable configurations. For example, the solvent extraction may be conducted as a single stage or multiple stage extraction process. The hydrocarbon solvents may be any solvent that is capable of successfully extracting the bitumen from the carrier material.

In one embodiment, the solvent extraction process includes two stages that use different solvents for each stage. The bitumen ore material is mixed with a light aromatic solvent to form a first mixture. The first mixture is separated to produce a first solvent-enriched phase and first tailings. The first tailings are then mixed with a volatile hydrocarbon solvent to form a second mixture. Mixing of the first tailings and the volatile hydrocarbon solvent can be carried out in a two stages: a first stage in which the volatile hydrocarbon solvent is liquid, and a second stage in which the volatile hydrocarbon solvent is a vapor. The second mixture may be separated to produce a second solvent-enriched phase and second tailings.

The tailings produced by the solvent extraction portion of the process typically include a large amount of carrier material, water, and residual solvent. If the bitumen ore material is from a natural source such as tar sands, the carrier material is largely made up of mineral solids.

The residual solvent in the tailings may be removed by moving hot gas through the tailings to volatilize the solvent. The solvent may be separated from the gas stream and recycled back to the process. The hot gas may include steam, carbon dioxide, nitrogen, and/or a hydrocarbon material. In one embodiment, the hot gas includes steam and/or gaseous solvent that is the same as the solvent being removed.

Any suitable drying system may be used to remove the solvent from the tailings. In one embodiment, the drying system includes a drying having a plurality of trays that form separate drying stages. The tailings enter at a tray near the top of the dryer and then successively fall to lower trays until it is eventually discharged. The heated gas moves upward through the dryer in a countercurrent fashion. The residual solvent is volatilized and carried away by the heated gas for further processing.

In another embodiment, the drying system may include a fluidized bed dryer. The tailings are fluidized by the heated gas passing through the tailings particles. In some situations, the particle size of the tailings may need to be adjusted to successfully create a fluidized bed.

In another embodiment, the drying system may be a rotary dryer. The rotary dryer may be operated in a counter current fashion, with the tailings traveling in one direction, and the gas traveling in an opposite direction of the tailings.

The drying system is capable of reducing the amount of solvent in the tailings to levels that make it suitable to be discharged back into the environment. In one embodiment, the amount of hydrocarbon solvent discharged in the tailings is less than 4 bbl per 1000 bbl of recovered bitumen. In another embodiment, the amount of hydrocarbon solvent in the tailings is less than 500 ppm.

It should be appreciated that the terms "solvent," "a solvent," and "the solvent" include one or more individual solvent compounds unless expressly indicated otherwise. It should also be appreciated that the term "tar sands" includes oil sands. The separations described herein can be partial, substantial, or complete separations unless indicated otherwise.

The foregoing and other features, utilities, and advantages of the subject matter described herein will be apparent from the following more particular description of certain embodiments as illustrated in the accompanying drawings. In this regard, it is to be understood that the scope of the invention is to be determined by the claims as issued and not by whether given subject includes any or all features or aspects noted in this Summary or addresses any issues noted in the Background.

DRAWINGS

The preferred and other embodiments are disclosed in association with the accompanying drawings in which.

DETAILED DESCRIPTION

Figure 1:
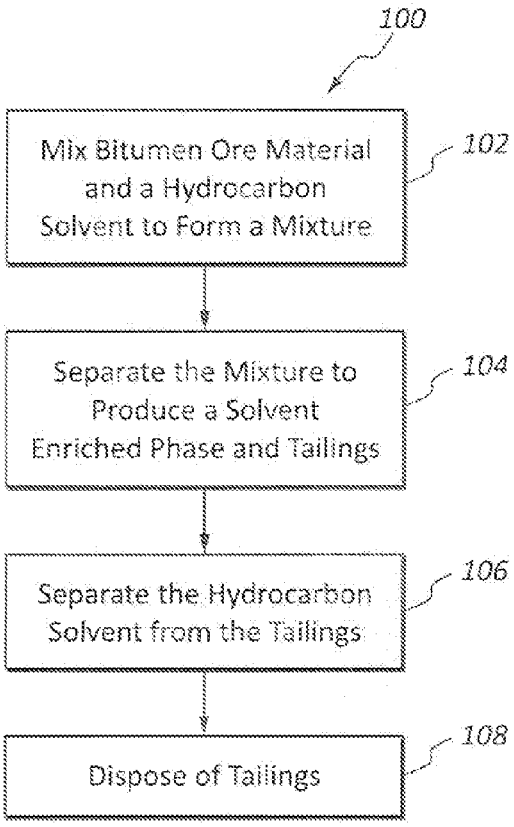
FIG. 1 is a flow chart of one embodiment of a process for separating bitumen from bitumen carrier material that includes a single solvent extraction stage.

With reference to FIG. 1, one embodiment of a process 100 for separating bitumen from bitumen ore material is shown. The process 100 includes mixing 102 the bitumen ore material with a hydrocarbon solvent to form a mixture. The mixture is then separated 104 to produce a solvent enriched phase and tailings. The tailings are processed to separate 106 residual amounts of the hydrocarbon solvent. The tailings are then disposed 108 of back to the environment.

The bitumen ore material used in the process 100 may be obtained from any of a number of sources. Exemplary sources of bitumen ore material include naturally occurring geological deposits such as tar sands, black shales, coal formations, and hydrocarbon sources contained in sandstones and carbonates. The bitumen ore material may be obtained by any suitable method such as surface mining, underground mining, and the like.

The composition of the bitumen ore material may vary widely. In one embodiment, the bitumen ore material may include at least approximately 3 wt % bitumen. In another embodiment, the bitumen ore material may include approximately 3 wt % to 21 wt % bitumen. The bitumen ore material may also include approximately 1 wt % to 10 wt % water.

Tar sands are used throughout the following description as an exemplary bitumen ore material since tar sands represent one of the largest and most prevalent sources of bitumen. However, it should be appreciated that the systems and methods described herein are not limited to tar sands and may be applied to any of a number of other bitumen ore materials.

Mixing 102 the bitumen ore material with the hydrocarbon solvent to form a mixture represents a solvent extraction step (also sometimes referred to as dissolution, solvation, or leaching). Solvent extraction is a process of separating a substance from a material by dissolving the substance in a liquid. In this situation, the bitumen ore material is mixed with the hydrocarbon solvent to dissolve bitumen and thereby separate it from the other components of the ore material such as, for example, the mineral solids in tar sands.

The hydrocarbon solvent may include any hydrocarbon that is capable of partially or completely solvating bitumen. The solvent may include a single hydrocarbon compound or a mixture of compounds. The solvent may be tailored to solvate all or part of the bitumen. For example, an aromatic solvent may be used to solvate all or almost all of the bitumen including the heavy asphaltene fraction. A volatile hydrocarbon solvent may be used to solvate most of the bitumen but precipitate the asphaltene fraction.

In one embodiment, the hydrocarbon solvent may be a light aromatic solvent that is capable of solvating the asphaltene fraction in the bitumen. The light aromatic solvent may have a boiling point of no more than about 400° C. at atmospheric pressure. In other embodiments, the light aromatic solvent may have a boiling point of about 75° C. to 350° C. at atmospheric pressure or a boiling point of about 100° C. to 250° C. at atmospheric pressure.

It should be appreciated that the light aromatic solvent need not contain 100% aromatic compounds. Instead, the light aromatic solvent may include a mixture of aromatic and non-aromatic compounds. For example, the first solvent can include greater than zero to about 100 wt % aromatic compounds, such as approximately 10 wt % to 100 wt % aromatic compounds, or approximately 20 wt % to 100 wt % aromatic compounds.

The light aromatic solvent may include any of a number of suitable hydrocarbon compounds. Examples of suitable hydrocarbon compounds include benzene, toluene, xylene, aromatic alcohols and combinations and derivatives thereof. The light aromatic solvent may also include compositions such as kerosene, diesel (including biodiesel), light gas oil, light distillate (distillates having boiling point of about 140° C. to 260° C.), commercial aromatic solvents such as Solvesso 100, Solvesso 150, and Solvesso 200 (also known in the U.S.A. as Aromatic 100, 150, and 200, including mainly C10-C11 aromatics, and produced by ExxonMobil), and/or naphtha. Naphtha, for example, is particularly effective at dissolving bitumen and is generally compatible with refinery operations.

In another embodiment, the hydrocarbon solvent may be a volatile hydrocarbon solvent that is capable of precipitating the asphaltene fraction in the bitumen. Volatile hydrocarbon solvents generally include hydrocarbons having a boiling point of about −20° C. to 150° C.

Volatile hydrocarbon solvents may include aliphatic compounds that are capable of solvating at least a portion of the bitumen. Suitable aliphatic compounds include linear and branched alkanes and alkenes.

In one embodiment, the volatile hydrocarbon solvent includes one or more aliphatic hydrocarbons having 3 to 9 carbon atoms and few, if any, aliphatic hydrocarbons having more than 9 carbon atoms. The volatile hydrocarbon solvent may also include lower carbon paraffins, such as cyclo- and iso-paraffins having 3 to 9 carbon atoms. Examples of suitable volatile hydrocarbons include liquefied petroleum gas (LPG), propane, butane, pentane, hexane, heptane, alkene equivalents of these compounds and/or combinations and derivatives thereof.

When choosing a hydrocarbon solvent it is normally desirable to use one that is economical and relatively easy to handle and store. It may also be desirable for the hydrocarbon solvent to be generally compatible with refinery operations.

The bitumen ore material and the hydrocarbon solvent may be mixed in any suitable manner and for any suitable period of time. The mixing is preferably carried out until most, if not all, of the bitumen is dissolved. If a volatile hydrocarbon solvent is used, the mixing may be conducted under pressure to prevent the solvent from volatilizing.

In one embodiment, the bitumen ore material and the hydrocarbon solvent may be mixed in a vessel to dissolve the bitumen and form a mixture. The vessel may be open or closed and may contain mixing mechanisms that promote dissolution of the bitumen in the hydrocarbon solvent. For example, the vessel may contain a powered mixing device, such as a rotating blade, to mix the contents of the vessel. In another example, the vessel itself may rotate to mix the bitumen ore material and the hydrocarbon solvent. In some embodiments, the vessel may be a pulper.

The bitumen ore material and the hydrocarbon solvent may also be mixed by virtue of the manner in which the materials are introduced into the vessel. For example, the hydrocarbon solvent may be introduced into the vessel at a high velocity, thereby agitating and mixing the contents of the vessel. The bitumen ore material may also be introduced into the vessel in an aggressive manner that promotes mixing.

Mixing 102 the bitumen ore material and the hydrocarbon solvent can be performed as a continuous, batch, or semi-batch process. Continuous processing is often used in larger scale implementations. However, batch processing may result in more complete separation and recovery of bitumen.

Enough hydrocarbon solvent should be added to the bitumen ore material to effectively dissolve at least a portion of the bitumen. The amount of solvent used may depend on the amount of bitumen present in the bitumen ore material. For example, more solvent may be required for lower grade tar sands ore (e.g., 6 wt % bitumen) than for higher grade tar sands ore (e.g., 12 wt % bitumen).

In one embodiment, the amount of hydrocarbon solvent added may be approximately 0.5 to 3.0 times the amount of bitumen contained in the bitumen ore material, approximately 0.6 to 2.0 times the amount of the bitumen contained in the bitumen ore material, or approximately 0.75 to 1.5 times the amount of bitumen contained in the bitumen ore material.

The mixture of the hydrocarbon solvent and the bitumen ore material may produce a bitumen-enriched solvent phase within the first mixture, with the majority of the bitumen dissolved in the bitumen-enriched solvent phase. In one embodiment, a solvent may be used that is capable of solvating asphaltenes. In this situation, the bitumen-enriched solvent phase may include 90%, preferably 95%, and most preferably 99% or more of the bitumen. In another embodiment, a solvent may be used that precipitates asphaltenes. In this situation, the bitumen-enriched solvent phase may include 90%, preferably 95%, and most preferably 99% or more of the non-asphaltene bitumen.

The mixture is separated 104 to produce a solvent phase and tailings. The solvent phase contains most, if not all, of the bitumen. Any suitable process may be used to separate the bitumen-enriched solvent phase from the tailings. Examples of suitable processes include filtering (including filtration via an automatic pressure filter or a plate and frame type filter press), settling and decanting, or by gravity or gas overpressure drainage.

The composition of the solvent phase may be about 5 wt % to 50 wt % bitumen and about 50 wt % to 95 wt % of the hydrocarbon solvent. The solvent phase may include little or no non-bitumen components, such as mineral solids, from the bitumen ore material.

The composition of the tailings may be about 75 wt % to 95 wt % non-bitumen components such as mineral solids, about 5 wt % to 25 wt % hydrocarbon solvent, and the remainder is water. The hydrocarbon solvent in the tailings is residual solvent that is not removed by the separation step 104. The residual hydrocarbon solvent may also contain some dissolved bitumen.

The mixing vessel mentioned previously may function as both the mixer and the separator. Alternatively, separate vessels can be used for mixing 102 and separating 104. In one embodiment, the vessel may be divided into different sections that serve different purposes. For example, one section may be used to mix the bitumen ore material and the hydrocarbon solvent and another section may be used to separate the mixture to produce the bitumen-enriched solvent phase and the tailings.

The separation step 104 may be performed as a continuous, batch, or semi-batch process. Continuous processing is often used in larger scale implementations. However, batch processing may result in more complete separation and recovery of bitumen.

The bitumen-enriched solvent phase may be separated further to recover the hydrocarbon solvent, remove any residual water or mineral solids that may be present, and create a concentrated bitumen product. The hydrocarbon solvent may be recycled back and mixed with additional bitumen ore material. The water and mineral solids may be combined with the tailings for further processing.

The bitumen-enriched solvent phase may be separated using any suitable process and/or equipment. In one embodiment, the bitumen-enriched solvent phase may be heated and the various components separated based on boiling point differences. For example, the solvent phase may be separated using a distillation process. A multi-hearth solvent recovery furnace may also be used.

If the solvent includes volatile hydrocarbons, the solvent and bitumen may be separated by flashing the mixture. The more volatile hydrocarbon solvent may become a gas that can be condensed and recycled back to the process 100. The bitumen product produced after separating the solvent phase may be upgraded further to produce valuable petroleum products such as gasoline, diesel, and the like.

The residual hydrocarbon solvent is separated 106 from the tailings. This may be accomplished using a drying system 150. The details a suitable drying system are described in greater detail below in connection with FIG. 3. Preferably, the drying system 150 is capable of reducing the amount of hydrocarbon solvent in the tailings to no more than 4 bbl per 1000 bbl of recovered bitumen. Additional hydrocarbon solvent may be removed to meet more stringent regulatory limits.

Figure 2:
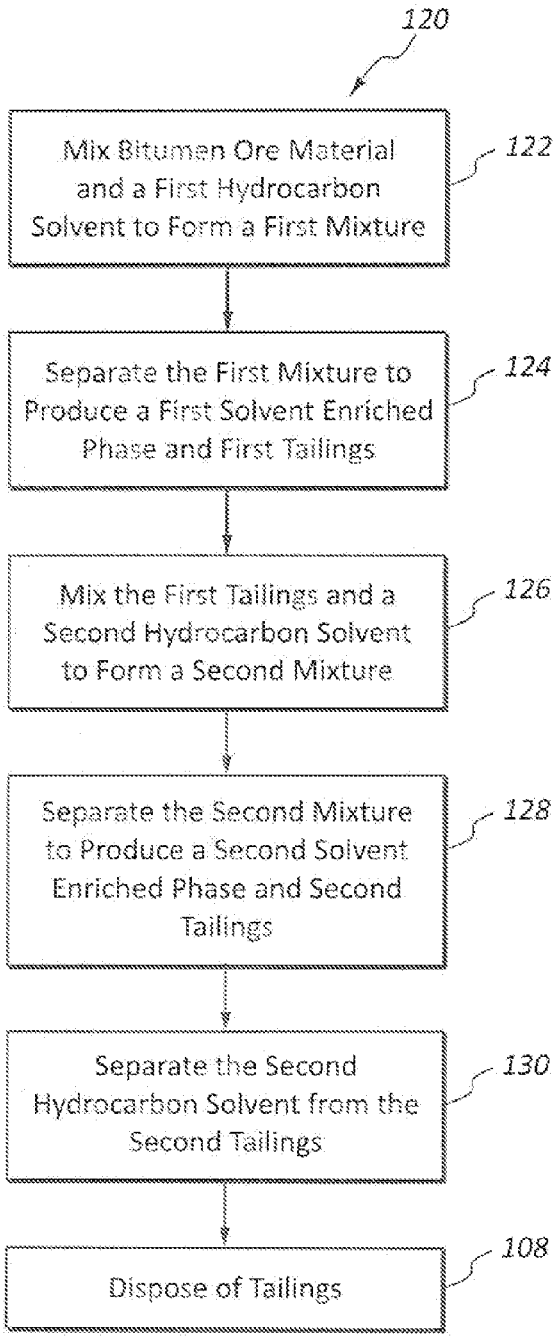
FIG. 2 is a flow chart of another embodiment of a process for separating bitumen from bitumen carrier material that includes two solvent extraction stages.

Another embodiment of a process 120 for separating bitumen from bitumen ore material is shown in FIG. 2. The process 120 is similar to the process 100 except that the process 120 includes a second solvent extraction step. It should be appreciated that other embodiments may include more than two solvent extraction steps.

The process 120 includes mixing 122 the bitumen ore material with a first hydrocarbon solvent to form a first mixture. The first mixture is then separated 124 to produce a first solvent enriched phase and first tailings. The first tailings are mixed 126 with a second hydrocarbon solvent to form a second mixture. The second mixture is separated 128 to produce a second solvent enriched phase and second tailings. The second tailings are processed to separate 130 residual amounts of the second hydrocarbon solvent. The tailings are then disposed 108 of back to the environment.

The first tailings from the first mixture may include a residual amount of the first hydrocarbon solvent and bitumen. The second extraction stage may remove the residual first solvent and bitumen from the first tailings. The addition of the second hydrocarbon solvent to the first tailings displaces the residual first hydrocarbon solvent and bitumen. Some of the second hydrocarbon solvent may remain in the second tailings, but little to none of the first hydrocarbon solvent or bitumen remains.

The first and second hydrocarbon solvents may include any single solvent or combinations of solvents. In one embodiment, the first and second hydrocarbon solvents may be the same. For example, the first and second hydrocarbon solvents may both be the same light aromatic solvent or the same volatile hydrocarbon solvent.

In another embodiment, the first and second hydrocarbon solvents may be different but still fall under the same broader umbrella. For example, the solvents may be different but still qualify as light aromatic solvents or volatile hydrocarbon solvents. An example where both solvents are light aromatic solvents may occur when the first hydrocarbon solvent is largely naphtha and the second hydrocarbon solvent is Solvesso 200. Likewise, an example where both solvents are volatile hydrocarbon solvents may occur when the first hydrocarbon solvent is largely pentane and the second hydrocarbon solvent is LPG.

In yet another embodiment, the first and second hydrocarbon solvents may be selected to have different properties that optimize extraction and separation of the various materials. For example, the first hydrocarbon solvent may be a light aromatic solvent that is capable of solvating the asphaltene fraction in the bitumen. The second hydrocarbon solvent may be a volatile hydrocarbon solvent that effectively removes the first hydrocarbon solvent and any residual bitumen, but can also be easily separated and returned to the process 120.

Any suitable amount of the first hydrocarbon solvent and second hydrocarbon solvent may be used to solvate and extract the bitumen. In one embodiment, the amount of either the first hydrocarbon solvent or second hydrocarbon solvent included in the first mixture or the second mixture, respectively, may be the same as the amounts described above in connection with the process 100. In another embodiment, the second hydrocarbon solvent may be included in the second mixture in an amount that is about 10% to 200% of the quantity of first hydrocarbon solvent included in the first mixture.

In step 122, the first hydrocarbon solvent is mixed with bitumen ore material. The mixing may be similar or identical to mixing step 102 described in greater: detail above. The mixing step can be carried out in a co-current or countercurrent process. The countercurrent process may generally include moving the bitumen ore material in one direction while passing the first solvent through in an opposite direction.

In some embodiments, the first hydrocarbon solvent is an aromatic solvent as described in greater detail above. In some embodiments, the first hydrocarbon solvent is heated prior to being mixed with the bitumen ore material. The first hydrocarbon solvent can be heated to a temperature of, for example, from 100 to 120° C. Heating, of the first hydrocarbon solvent can be useful in instances when the bitumen ore material is cold bitumen ore material, such as bitumen ore material having a temperature in the range of from 0 to 4° C.

In some embodiments, the mixing of first hydrocarbon solvent and bitumen ore material can occur in multiple stages. For example, in some embodiments, a crushing operation is performed on the bitumen ore material to reduce the size of the bitumen ore pieces. First hydrocarbon solvent can be added to the bitumen ore material before or during this crushing operation. The first hydrocarbon solvent that is used as part of the crushing operation can be warm first hydrocarbon solvent, such as first hydrocarbon solvent heated to a temperature in the range of 30 to 60° C.

Following the crushing operation, additional first hydrocarbon solvent can be mixed with the crushed bitumen ore material in a manner that is similar or identical to the mixing steps 102, 122 described above. The first hydrocarbon solvent used during this mixing step can be heated first hydrocarbon solvent.

Mixing 122 of first hydrocarbon solvent and bitumen ore material can also be carried out in more than one vessel. For example, in some embodiments, first hydrocarbon solvent is mixed with bitumen ore material in a vessel such as a pulper, followed by introducing the mixture of bitumen ore material and first hydrocarbon solvent in a hollow vertical column, where additional first hydrocarbon solvent is added at the top of the vertical column and allowed to flow down through the mixture loaded in the vertical column. Each first hydrocarbon solvent stream used can be heated in the range of from 100 to 120° C. prior to being mixed with the bitumen ore material.

In step 124, a first hydrocarbon solvent enriched phase is separated from the mixture of bitumen ore material and first hydrocarbon solvent. Step 124 can be carried out in a similar or identical fashion to step 104 described above in greater detail. Examples of suitable separation processes include filtering (including filtration via an automatic pressure filter or a plate and frame type filter press), settling and decanting, or by gravity or gas overpressure drainage. In embodiments where first hydrocarbon solvent is added at the top of a vertical column in which the mixture is loaded, the first solvent enriched phase can be separated from the first mixture by allowing the first hydrocarbon solvent to flow through mixture and exit the bottom end of the vertical column. The first hydrocarbon solvent that flows through the mixture can be laden with dissolved bitumen, and can therefore be collected at the bottom of the column and used as the first hydrocarbon solvent enriched phase.

In step 126, the tailings remaining after step 124 can be mixed with a second solvent. The mixing of the tailings and the solvent can be similar or identical to the mixing step 102 described above in greater detail. Mixing step 126 can also take place in a vertical column as described above in greater detail. In some embodiments, the second solvent is a volatile hydrocarbon solvent as described above in greater detail. In some preferred embodiments, the second solvent is paraffinic solvent, and most preferably the second solvent is pentane.

In step 128, a second hydrocarbon solvent enriched phase is separated from the mixture of tailings and second solvent. Step 128 can be carried out in a similar or identical fashion to step 104 described above in greater detail. Examples of suitable separation processes include filtering (including filtration via an automatic pressure filter or a plate and frame type filter press), settling and decanting, or by gravity or gas overpressure drainage. In embodiments where second hydrocarbon solvent is added at the top of a vertical column in which the tailings are loaded, the second hydrocarbon solvent enriched phase can be separated from, the mixture as the material that flows through mixture and exits the bottom end of the vertical column. The material that flows through the mixture can be a mixture of first hydrocarbon solvent, second hydrocarbon solvent, and bitumen dissolved in either solvent, and can therefore be collected at the bottom of the column and used as the second hydrocarbon solvent enriched phase.

Steps 126 and 128 can be performed in multiple stages. In some embodiments, a first stage of mixing liquid second hydrocarbon solvent with tailings and separating a second hydrocarbon solvent phase from the mixture is carried out in any of the manners described above, such as loading the tailings in a vertical column, adding second hydrocarbon solvent at the top of the column, and collecting the second hydrocarbon solvent enriched phase at the bottom of the vertical column. In a second stage, additional second hydrocarbon solvent is mixed with the tailings, but the second hydrocarbon solvent is in a vapor phase. The warm second hydrocarbon solvent vapor can vaporize and remove residual liquid second hydrocarbon solvent remaining in the tailings after the liquid second hydrocarbon solvent mixing stage. The vaporized second hydrocarbon solvent can be collected and condensed such that the solvent can be reused in the process. In embodiments where the tailings are loaded in a vertical column, the second hydrocarbon solvent vapor can be introduced at the bottom of the vertical column and be allowed to flow upwardly through and out of the column. When the vapor leaves the top of the column, the vapor can include first and/or second hydrocarbon solvent previously trapped in the tailings. In some embodiments, the second hydrocarbon solvent vapor used is heated and pressurized. The vapor can be heated to a temperature of about 80° C. and pressurized to about several atmospheres.

Following the addition of second hydrocarbon solvent vapor, the tailings can be flashed to further remove any residual second hydrocarbon solvent from the tailings. In embodiments where the second hydrocarbon solvent washing stages are carried out on tailings loaded in a vertical column, the pressure in the column can be reduced to about 1 atmosphere to flash and remove residual amounts of second hydrocarbon solvent contained therein (such as second hydrocarbon solvent vapor introduced into the tailings but that does not travel all the way through the column). In some embodiments, the two stage addition of second hydrocarbon solvent (in a first stage liquid phase and a second stage vapor phase) followed by a flashing step can result in the tailings having less than 5 wt % second hydrocarbon solvent (preferably less than 1 wt %) and less than 0.5 wt % first hydrocarbon solvent. The majority of the remaining second hydrocarbon solvent will be second hydrocarbon solvent vapor trapped in the pores of the tailings.

The first and second hydrocarbon solvent enriched phases produced in steps 124 and 128 may be processed to recover the hydrocarbon solvents and isolate the bitumen in any of the ways described above in connection with the process 100. In one embodiment, the first and second hydrocarbon solvent enriched phases may be combined before the bitumen is separated. In some embodiments, the solvent enriched phases are subjected to filtering and/or centrifuging to remove solids/fines prior to separating the solvent from the bitumen. For example, the solvent enriched phases can be processed in a centrifuge operating at from 6,500 to 15,000 g in order to remove solids/fines. When the solvent is separated from the bitumen, the recovered hydrocarbon solvents may be recycled back to the process 120. The bitumen product may be upgraded further to produce a variety of commercially valuable petroleum products. The bitumen product may also be filtered and/or centrifuged to remove further solids/fines. Bitumen product quality can be defined by the Bottom Sediment and Water (BS&W) content, and in some embodiments is between 0.2 to 0.5 wt % solids prior to filtering and/or centrifuging. After filtering and/or centrifuging, the BS&W content can be reduced to less that 0.1 wt % solids (1000 ppm). In some embodiments, the bitumen product processed in a centrifuge operating at from 6,500 to 15,000 g to result in dry bitumen product with improved BS&W content.

The tailings remaining after step 128 may still include a residual amount of second hydrocarbon solvent. In step 130, the residual second hydrocarbon solvent remaining in the tailings is further separated from the tailings. In some embodiments, this may be accomplished using a drying system 150. The details of a suitable drying system 150 are described in greater detail below in connection with FIG. 3. Preferably, the drying system 150 is capable of reducing the amount of hydrocarbon solvent in the tailings to no more than 4 bbl per 1000 bbl of recovered bitumen. Additional hydrocarbon solvent may be removed to meet more stringent regulatory limits.

In another embodiment, the solvent extraction portion of the processes 100, 120 may be replaced by the solvent extraction processes described in the materials that are incorporated by reference at the beginning of this document. It should also be appreciated that the process steps described herein may have the same or similar characteristics as the processes described in the incorporated material. For example, the composition of the various solvent enriched phases, tailings, and the like, may be the same or similar as the composition of the corresponding materials in the incorporated documents.

The process 120 may be capable of recovering at least approximately 93 wt %, at least approximately 95 wt %, or at least approximately 97 wt % of the bitumen in ore material. Most of the bitumen is separated in the first solvent extraction step. In one embodiment, the first tailings may include approximately 0.5 wt % to 5 wt % bitumen. The second solvent extraction step may separate the residual first hydrocarbon solvent and almost all of the remaining bitumen. The second tailings may include no more than approximately 2 wt % bitumen, no more than approximately 1 wt % bitumen, or, desirably, no more than 0.5 wt % bitumen.

Figure 3:
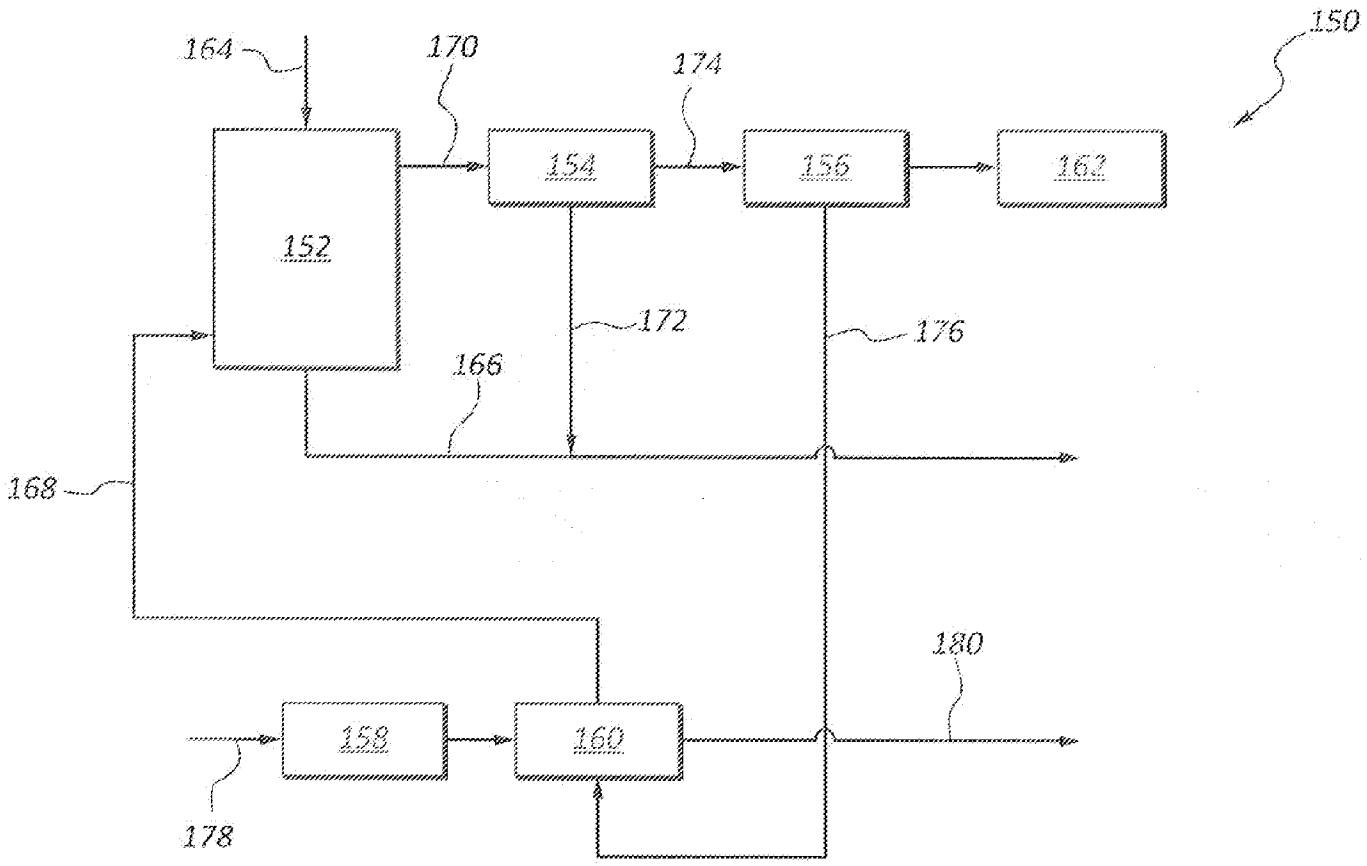
FIG. 3 is a schematic diagram of one embodiment of a drying process that may be used to separate residual solvent from the tailings.

Turning to FIG. 3, a schematic of one embodiment of a drying system 150 is depicted. The drying system 150 includes a dryer 152, a solids collection system 154, a solvent separation unit 156, a heater 158, a heat exchanger 160, and a solvent collection tank 162.

The tailings 164 enter the dryer 152 and interact with a heated gas 168 to volatilize the any residual solvent in the tailings 164. The hydrocarbon solvent vapor exits the dryer 152 with the gas 168. The dried or final tailings 166 exit the dryer 152 and are disposed of back to the environment.

In one embodiment, the tailings 164 and the heated gas 168 flow through the dryer 152 in a countercurrent fashion. For example, as depicted in FIG. 3, the tailings may enter at the top of the dryer 152, flow downward, and exit near the bottom of the dryer 152. The heated gas may enter at the bottom of the dryer 152, flow upward, and exit near the top of the dryer 152.

The heated gas 168 may include any material that is capable of volatilizing the hydrocarbon solvent in the tailings. Examples of suitable materials include steam, nitrogen, carbon dioxide, and/or vapor that has the same composition as the hydrocarbon solvent in the tailings.

The solvent laden gas stream 170 exits the dryer 152 and enters the solids collection system 154 to remove any remaining solids 172. It should be appreciated that any suitable solids collection system may be used to remove the solids 172. Examples of suitable solid collections systems 154 include inertial separation systems such as baffle chambers and centrifugal collectors (e.g., cyclones), fabric filter systems such as baghouses, wet scrubbers, electrostatic precipitators, and/or unit collectors.

In one embodiment, the solids collection system 154 may include a baghouse. The solvent laden gas stream 170 enters the baghouse and passes through filter bags. Larger particles drop to the bottom of the baghouse while smaller particles collect on the filter bags. When the particle layer thickness on the filter bags reaches a level where flow through the system is restricted the bag cleaning process is initiated. Cleaning can be done while the baghouse is online or isolated offline. Once cleaned, the compartment is placed back in service and the filtering process starts over.

It should be appreciated that any suitable type of baghouse may be used to filter the solids 172 from the gas stream 170. Examples of suitable baghouses include reverse air, pulse air, or shaker baghouses. The solids 172 that exit the solids collection system 154 are combined with the dry tailings 166 and disposed of accordingly.

The gas stream 174 that exits the solids collection system 154 contains a mixture of heated gas 168 and hydrocarbon solvent. The gas stream 174 moves to the solvent separation unit 156 where the hydrocarbon solvent is separated from the heated gas 168.

The solvent separation unit 156 may be any separation system or device that is capable of separating the gas stream 174 to recover the hydrocarbon solvent and recycle the heated gas 168. In one embodiment, the solvent separation unit 156 may be the same or similar to the separation units mentioned above in connection with separating the solvent enriched phases.

In one embodiment, the solvent separation unit 156 may include a condenser and decanter. The condenser may be used to condense all or a portion of the gas stream 174. Depending on the composition of the gas stream 174, the liquid produced may include the hydrocarbon solvent, water, and any other condensable, gas that was in the heated gas 168. The hydrocarbon solvent may be separated from the water in the decanter, stored in the solvent collection tank 162, and eventually recycled back to the process 100, 120.

If the condenser is unable to remove a sufficient quantity of the hydrocarbon solvent from the gas stream 174, then additional processing may be required. In one embodiment, the gas stream 174 may travel through the condenser where water and a first quantity of the hydrocarbon solvent are removed and then proceed to a pressure swing adsorption unit to remove an additional quantity of the hydrocarbon solvent. Other configurations may also be used.

A fluid stream 176 exits the solvent separation unit 156 and flows to the heat exchanger 160 where the fluid 176 is heated to produce the heated gas 168. In some embodiments, the fluid stream 176 may be a gas that does not undergo a phase change in the heat exchanger 160. In other embodiments, the fluid stream 176 may be a liquid that undergoes a phase change in the heat exchanger 160 to a gas. Either way, the gas may be superheated to increase its drying effectiveness. It should be appreciated that any suitable heat exchanger 160 may be used to produce the heated gas 168.

The heater 158 supplies indirect heat to the fluid stream 176: by way of the heat exchanger 160. The heater 158 may be any suitable heater capable of providing the specified amount of heat. In one embodiment, the heater 158 burns natural gas 178 to heat the fluid stream 176 and produce the heated gas 168. The exhaust 180 from the heater 158 is vented to the atmosphere. It should be appreciated that the heater 158 and the heat exchanger 160 may be provided as an integral unit.

The dryer 152 may include any suitable type of dryer. Examples of suitable dryers include rotary kiln dryers, fluidized bed dryers (stationary or bubbling beds, circulating beds, vibratory fluidized beds), belt dryers, drum dryers, shelf dryers, paddle dryers, rotary dryers, filter dryers, and vacuum conical dryers.

Figure 4:
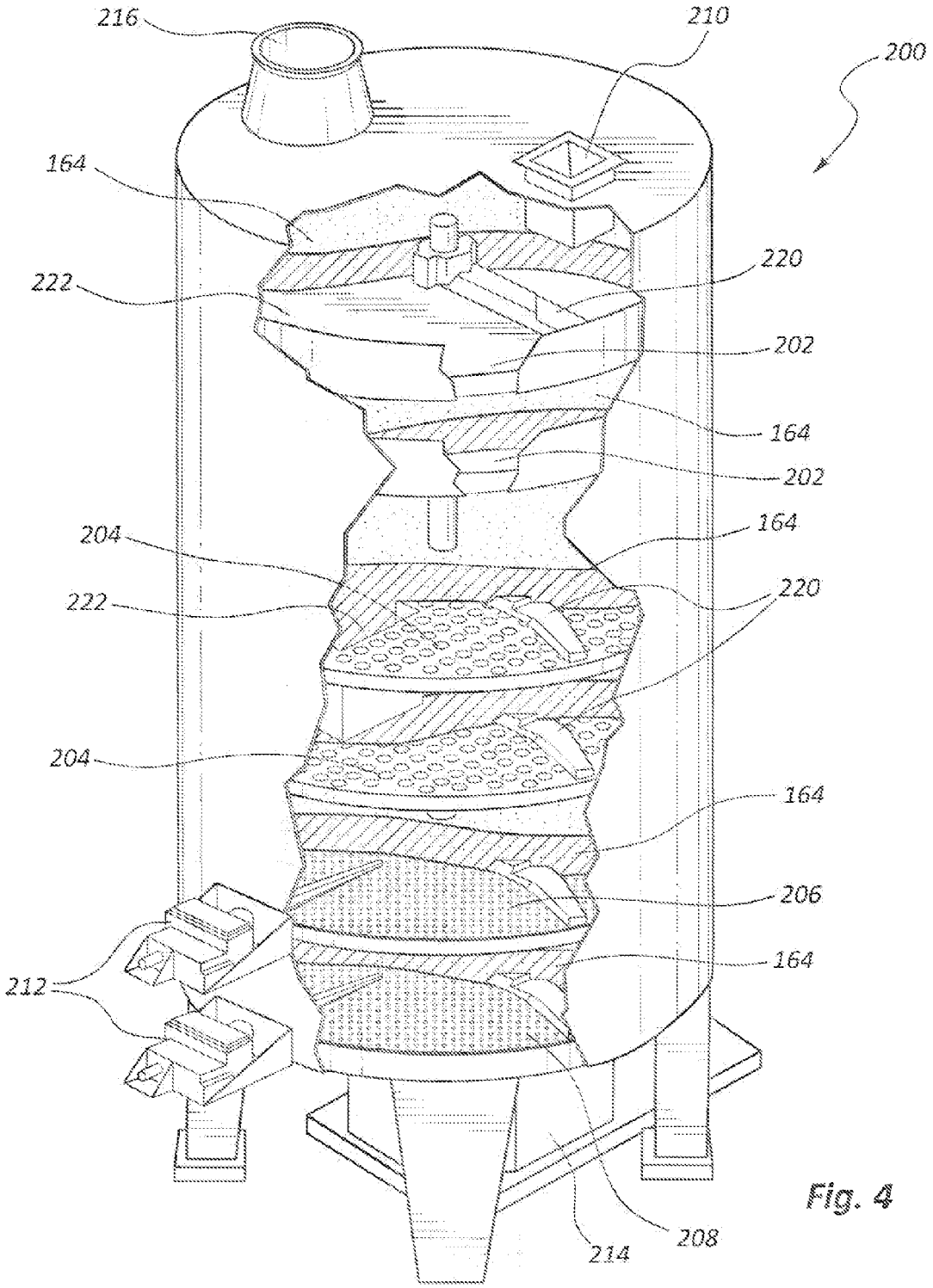
FIG. 4 is a cut-away perspective view of one embodiment of a dryer that may be used to separate residual solvent from the tailings.

FIG. 4 shows one embodiment of a dryer 200 that may be used in the drying system 150. The dryer 200 includes a tailings inlet 210, tailings outlets 212, a heated gas inlet 214, a heated gas outlet 216, and a plurality of drying trays 202, 204, 206, 208. The dryer 200 removes the hydrocarbon solvent at separate stages, represented by the trays 202, 204, 206, 208, as the tailings 164 move through the dryer 200.

The tailings 164 enter the dryer 200 through the tailings inlet 210 at the top of the dryer 200 and move downward through the plurality of drying trays 202, 204, 206, 208 until the tailings 164 exit through the tailings outlets 212. The heated gas enters through the heated gas inlet 214 at the bottom of the dryer 200 and moves upward until it exits through the heated gas outlet 216. In this way, the tailings 164 and the heated gas 168 move through the dryer 200 in a countercurrent fashion.

The tailings 164 fall onto each tray 202, 204, 206, 208 where they are evenly distributed by a sweep arm 220. The tailings 164 move from one tray to the next through tray openings 222. At each successive tray, additional hydrocarbon solvent is removed from the tailings 164.

The upper trays 202 may be indirectly heated by the heated gas 168 so that the heated gas 168 does not come into direct contact with the tailings 164. This may be especially useful when the heated gas 168 contains a significant amount of steam. The heat from the trays 202 causes the hydrocarbon solvent in the tailings 164 to evaporate without adding any water.

The middle trays 204 may be designed to indirectly and directly heat the tailings 164. These trays 204 may include hollow stay bolts for venting the heated gas 168 from one tray to the next. The quantity and position of the openings may be designed to maximize solvent removal from the tailings 164.

The trays 206, 208 are where the heated gas enters the dryer 200 and where the tailings 164 exit the dryer 200. The trays 206, 208 are perforated to allow direct injection of the heated gas 168 into the tailings 164. The outlets 212 may include a variable speed rotary valve that is capable of maintaining a certain level of material in the unit. The lowermost tray 208 may be maintained at just above ambient pressure to reduce or prevent any heated gas 168 from leaking out of the final outlet 212.

In one embodiment, the drying system 150 may be configured to evaporate the hydrocarbon solvent in the dryer 152 and condense it in the solvent separation unit 156. The hydrocarbon solvent should be selected to minimize the amount of energy needed to perform both of these operations. If the boiling point of the hydrocarbon solvent is too low, it evaporates easily, but takes a substantial amount of energy to cool sufficiently to condense. If the boiling point of the hydrocarbon solvent is too high, it takes a substantial amount of energy to evaporate, but condenses easily.

One problem with using a hydrocarbon solvent having a high boiling point is that all of the tailings, including any residual water, must be heated to a much higher temperature to volatilize the solvent. As the temperature goes up, the amount of water evaporated with the solvent increases. This is wasted energy since any residual water in the tailings does not need to be removed.

Examples of suitable hydrocarbon solvents include butane, pentane, hexane, heptane, and/or mixtures and combinations of these that have similar boiling points. Preferably, the solvent may be pentane since it requires the least amount of energy to evaporate and condense. In one embodiment, the hydrocarbon solvent has a boiling point of approximately 20° C. to 50° C. or, preferably, approximately 30° C. to 40° C.

Figure 6:
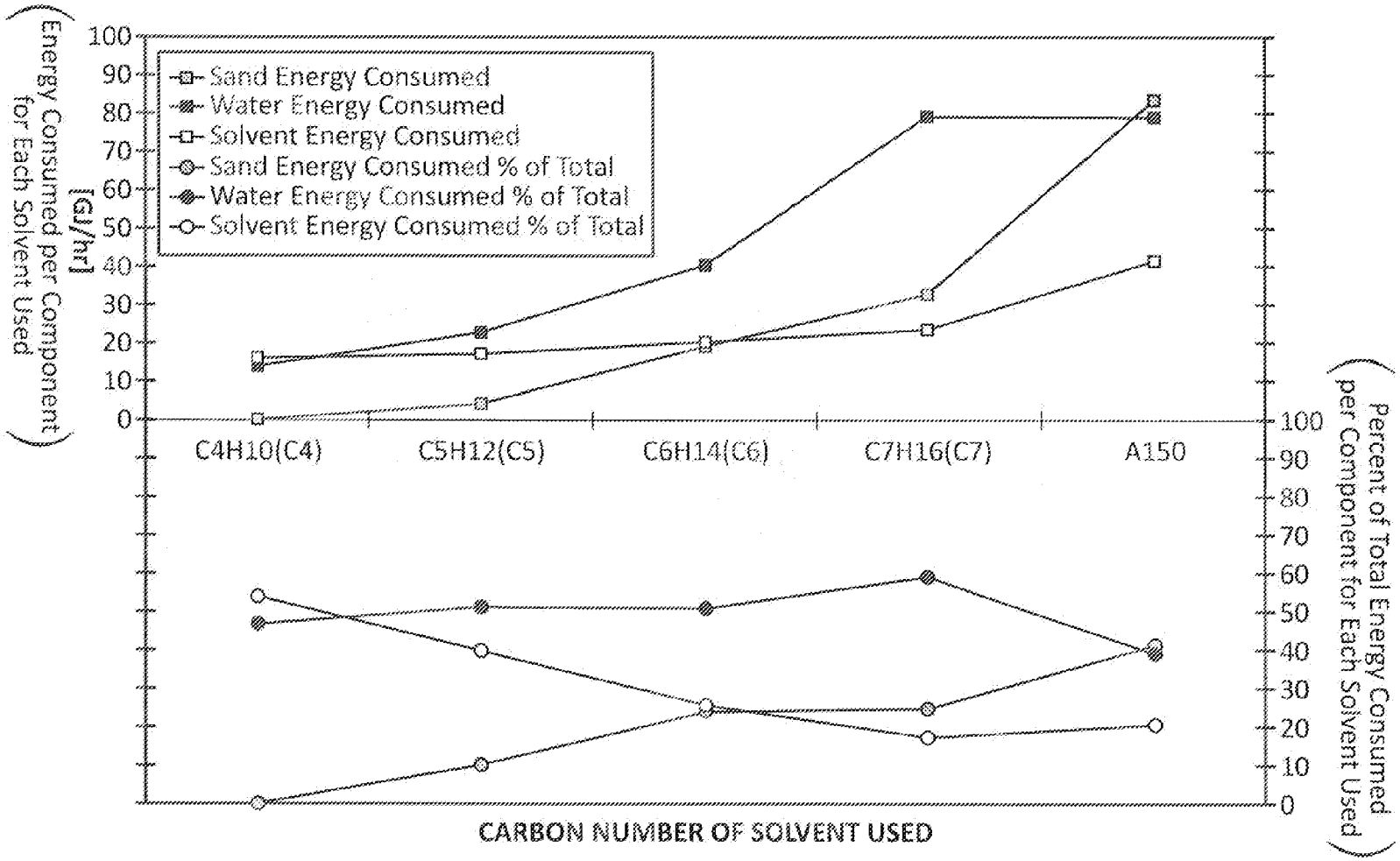
FIG. 6 is a chart that shows the energy requirements of the various components in the drying system.

FIG. 6 is a chart that shows the amount of heat required to volatilize different solvents in the dryer 152. The chart shows that as the boiling point of the solvent increases, the amount of energy also increases. However, most of the increased energy is being used to volatilize the water and heat the sand rather than volatilize the solvent.

The conclusions drawn from the data in this chart must be balanced against the energy required to condense the solvent in the solvent separation unit 156. Although butane requires the least amount of energy to recover it from the tailings 164, it requires a substantial amount of energy to condense and separate it in the solvent separation unit 156. Pentane, on the other hand, requires a little bit more energy to remove it from the tailings 164, but requires much less energy to condense it in the solvent separation unit 156.

The heated gas 168 may include a combination of the hydrocarbon solvent vapor, residual steam, and non-condensable (under the processing conditions stated herein), relatively inert gases such as nitrogen and/or carbon dioxide. The inert gases may be provided to maintain a baseline gas pressure in the drying system 150 regardless of the amount of hydrocarbon solvent that condenses in the solvent separation unit 156.

The heated gas 168 may be supplied at any suitable temperature. Since the heated gas 168 in this embodiment includes some quantity of hydrocarbon solvent, the temperature of the heated gas 168 should not exceed the temperature at which the hydrocarbon solvent begins to thermally crack. In one embodiment, the temperature of the heated gas 168 may be at least 290° C. and no more than 400° C. This should provide the heated gas 168 with sufficient energy to evaporate the hydrocarbon solvent in the tailings 164 but prevent it from thermally cracking.

The heated gas 168 passes through the dryer 152 and becomes laden with additional hydrocarbon solvent vapor and some evaporated water. A condenser in the solvent separation unit 156 condenses the excess hydrocarbon solvent. The temperature and pressure in the condenser may be adjusted to control the partial pressures of the hydrocarbon solvent/water vapors and thus control the amount of hydrocarbon solvent/water in the fluid stream 176.

The pressure may be adjusted to increase the partial pressure of the hydrocarbon solvent allowing more solvent to be condensed at the same temperature. Compressing the gas stream 174 in the condenser increases solvent recovery and reduce losses. This may allow the dryer 152 to operate at atmospheric pressure while the solvent separation unit 156 operates at higher pressure.

The temperature and pressure in the condenser may vary widely depending on the hydrocarbon solvent being used In one embodiment, the temperature in the condenser may be approximately 10° C. to 36° C. The pressure in the condenser may be approximately 5 psig to 20 psig.

The amount of hydrocarbon solvent discharged in the dried tailings 166 depends on the concentration of hydrocarbon solvent in the heated gas 168 since void space in the mineral solids exiting the dryer 152 is occupied by the heated gas 168. In one embodiment, the hydrocarbon solvent may be pentane and the concentration of pentane in the heated gas 168 may be approximately 37 vol %. Hydrocarbon solvent losses in this embodiment may be approximately 3.7 bbl per 1000 bbl of recovered bitumen, which is lower than the target amount of no more than 4 bbl per 1000 bbl of recovered bitumen.

The amount of solvent discharged in the dried tailings 166 may be reduced by condensing more of the solvent in the solvent separation unit 156. There is a trade off, however, since doing so requires greater and greater amounts of energy for each additional quantity of solvent that is separated.

In another embodiment, the heated gas 168 may be primarily steam. The hydrocarbon solvent may be separated from the steam by condensing the gas stream 174 and decanting the hydrocarbon solvent. The water may be heated to form steam again in the heat exchanger 160. The advantage of using steam is that it contains high latent heat relative to the hydrocarbon solvent so that less steam is required to provide the heat necessary to evaporate the hydrocarbon solvent. Also, less hydrocarbon solvent may be present in the heated gas 168 thereby reducing the amount of solvent present in the voids of the tailings 164 when it is discharged.

It should be appreciated that a variety of changes may be made to the drying system 150 as depicted in FIG. 3. For example, the drying system 150 relies on indirect heating to heat the gas 168 which then flows through the dryer 152 and volatilizes the hydrocarbon solvent in the tailings 164. However, the drying system 150 may be modified to use direct heating, i.e., the hot gases from combustion enter the dryer 152 directly and volatilize the hydrocarbon solvent. Other changes and modifications may be made to the drying system 150.

Figure 5:
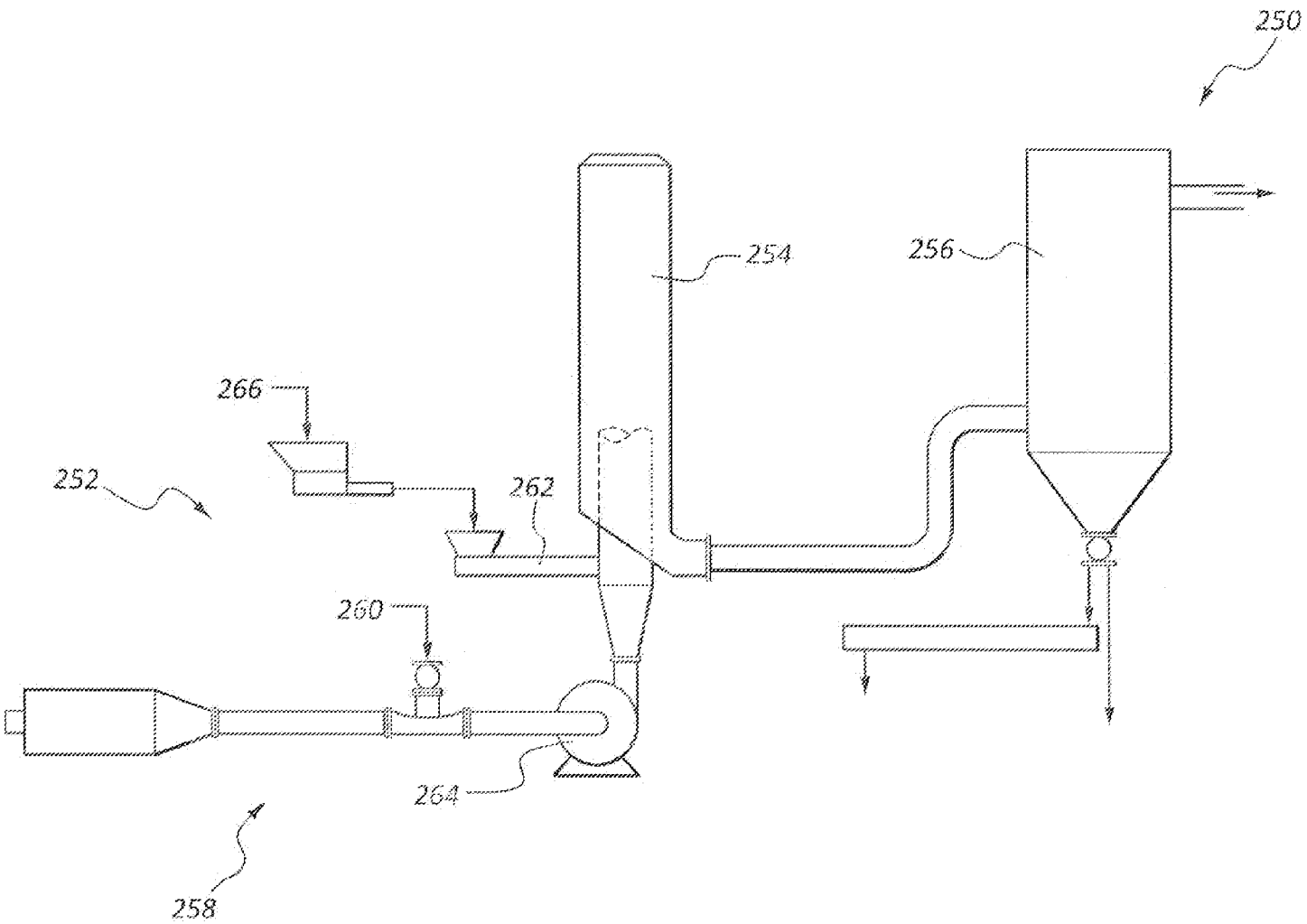
FIG. 5 is a schematic diagram of one embodiment of a drying system that includes a fluidized bed.

Turning to FIG. 5, a schematic diagram of another embodiment of a drying system 250 is shown. The drying system 250 includes a feeding system 252, a fluidized bed column 254, a solids separation unit 256, and a heated gas feed system 258. In many ways, the drying system 250 may be similar to the drying system 150. For example, the heated gas may contain the same materials described above. Also, the temperatures and other processing parameters may also apply to the drying system 250.

The tailings 164 may be fluidized in the column 254 by passing the heated gas through the tailings at a flow rate where the upward drag forces on the particles are the same as the downward gravitational forces. This causes the particles to become suspended within the heated gas. The bed volume begins to behave like a fluid by expanding to conform to the volume of the column and forming a surface that is perpendicular to gravity. Objects that have a lower density float on the surface while denser objects sink to the bottom.

Fluidized beds may provide a number of advantages. For example, fluidized beds produce extremely high surface area contract between the heated gas and the tailings per unit bed volume. They also have high relative velocities between the heated gas and the dispersed tailings. They also produce high levels of intermixing of the particulate phase and frequent particle-particle and particle-wall collisions.

The tailings may be mixed with the heated gas in a venturi feeder 260 or a screw feeder 262. If the tailings particles are too large (>100 microns) to be effectively fluidized, they may be pneumatically conveyed to a disperser 264 that breaks up large agglomerates and further mixes the tailings and the heated gas. If the tailings do not need to be resized, the tailings may be combined with the heated gas without using any moving parts. The drying system 250 may include a volumetric feeder 266 that can feed precise amounts of the tailings into the fluidized bed column 254 through the screw feeder 262.

The smaller tailings particles dry immediately and exit the fluidized bed column 254. They are then pneumatically conveyed to the solids separation unit 256. The coarser wet material remains in the fluidized bed column 254 and collides with other particles thereby exposing the wet material to the heated gas. The particles are then pneumatically conveyed to the solids separation unit 256. The tailings may then be disposed of or some amount may be recycled back through the drying system 250.

The amount of solvent in the tailings may be measured using a Thermo Gravimetric Analyzer. A Fourier Transfer Infrared instrument provides the exact composition of the residual solvent in the tailings before and after the drying operation. In one embodiment, both of these instruments may be used to quantify the amount of hydrocarbon solvent left in the tailings.

Any of the above processes may be automated using a variety of techniques. In one embodiment, tunable diode lasers may be used to automate the cycle time of the dryer so that it produces dry stackable tailings having a hydrocarbon solvent concentration that is no more than 500 ppm. The dryer cycle time, heated gas flow rate, temperature, etc., may be continuously controlled using the tunable diode laser to improve dryer performance.

Illustrative Embodiments

Reference is made in the following to a number of illustrative embodiments of the disclosed subject matter. The following embodiments illustrate only a few selected embodiments that may include one or more of the various features, characteristics, and advantages of the disclosed subject matter. Accordingly; the following embodiments should not be considered as being comprehensive of all of the possible embodiments. The concepts and aspects of one embodiment may apply equally to one or more other embodiments or may be used in combination with any of the concepts and aspects from the other embodiments. Any combination of any of the disclosed subject matter is contemplated.

In one embodiment, a method comprises: forming a first mixture by mixing bitumen ore material with a first hydrocarbon solvent; separating the first mixture to produce first tailings; forming a second mixture by mixing the first tailings with a second hydrocarbon solvent: separating the second mixture to produce second tailings; and separating the second hydrocarbon solvent from the second tailings with a heated gas that includes the second hydrocarbon solvent.

The heated gas may include steam. The second hydrocarbon solvent may be separated from the second tailings in a dryer that includes a plurality of separate drying trays. Separating the second hydrocarbon solvent from the second tailings may include moving the heated gas and the second tailings in a countercurrent fashion. The second hydrocarbon solvent may be separated from the second tailings in a fluidized bed.

The bitumen ore material may include tar sands. The first hydrocarbon solvent may include a light aromatic solvent. The second hydrocarbon solvent may include butane, pentane, and/or hexane. The second hydrocarbon solvent may include butane, pentane, and/or hexane.

In another embodiment, a method comprises: forming a mixture by mixing bitumen ore material with a hydrocarbon solvent; separating the mixture to produce a solvent phase and tailings; and separating the hydrocarbon solvent from the tailings by moving the tailings through a dryer that includes a plurality of drying trays. The dryer may include sweep arms positioned adjacent to each of the plurality of drying trays to move the tailings across the plurality of drying trays. The bitumen ore material may include tar sands. The hydrocarbon solvent may include butane, pentane, and/or hexane.

Separating the hydrocarbon solvent from the tailings may include moving heated gas through the tailings in the dryer. The heated gas may include steam. The heated gas input into the dryer may include the hydrocarbon solvent. The heated gas and the second tailings may move through the dryer in a countercurrent fashion. The at least one tray from the plurality of trays may only heat the tailings indirectly from heat supplied by the heated gas and at least one other tray from the plurality of trays may heat the tailings through direct contact with the heated gas.

The method may include forming a first mixture by mixing bitumen ore material with a first hydrocarbon solvent and separating the first mixture to produce a first solvent phase and first tailings. The mixture may then include forming a second mixture by mixing bitumen ore material with a second hydrocarbon solvent; separating the second mixture to produce a second solvent phase and second tailings; and separating the second hydrocarbon solvent from the tailings by moving the tailings through a dryer that includes a plurality of drying trays.

In another embodiment, a method comprises: forming a first mixture by mixing bitumen ore material with a first hydrocarbon solvent; separating the first mixture to produce a first solvent phase and first tailings; forming a second mixture by mixing the first tailings with a second hydrocarbon solvent; separating the second mixture to produce a second solvent phase and second tailings; and separating the second hydrocarbon solvent from the second tailings in a fluidized bed.

A heated gas may be used to fluidize the fluidized bed. The heated gas may include steam. The bitumen ore material may include tar sands. The first hydrocarbon solvent may include a light aromatic solvent. The second hydrocarbon solvent may include butane, pentane, and/or hexane.

The terms recited in the claims should be given their ordinary and customary meaning as determined by reference to relevant entries in widely used general dictionaries and/or relevant technical dictionaries, commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used in a manner that is more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure the term shall mean," etc.).

References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. The subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be given their broadest interpretation in view of the prior art and the meaning of the claim terms.

As used herein, spatial or directional terms, such as "left," "right," "front," "back," and the like, relate to the subject matter as it is shown in the drawings. However, it is to be understood that the described subject matter may assume various alternative orientations and, accordingly, such terms are not to be considered as limiting. Furthermore, articles such as "the" "a," and "an" can connote the singular or plural. Also, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

What is claimed is:

1. A method comprising:

mixing bitumen ore material with a heated first hydrocarbon solvent and forming a first mixture;

separating a first hydrocarbon solvent enriched phase from the first mixture and producing first tailings;

mixing the first tailings with a second hydrocarbon solvent liquid and forming a second mixture:

separating a second hydrocarbon solvent enriched phase from the second mixture and producing second tailings;

passing a second hydrocarbon solvent vapor through the second tailings;

flashing the second tailings after passing the second hydrocarbon solvent vapor through the second tailings and before removing second hydrocarbon solvent from the second tailings in a dryer; and removing second hydrocarbon solvent from the second tailings in a dryer.

2. The method of claim 1, wherein the heated first hydrocarbon solvent is heated to a temperature in the range of from 30 to 60° C.

3. The method of claim 1, wherein the bitumen ore material is at a temperature in the range of 0 to 4° C.

4. The method of claim 1, the first hydrocarbon solvent is an aromatic solvent.

5. The method of claim 1, wherein mixing bitumen ore material with a heated first hydrocarbon solvent comprises loading the bitumen ore material in a vertical column, adding heated first hydrocarbon solvent at the top of the vertical column, and allowing the heated first hydrocarbon solvent to flow down through the bitumen ore material loaded in the vertical column.

6. The method of claim 1, wherein the second hydrocarbon solvent is a paraffinic solvent.

7. The method of claim 5, wherein mixing the first tailings with a second hydrocarbon solvent liquid comprises adding second hydrocarbon solvent liquid, at the top of the vertical column and allowing the second hydrocarbon solvent liquid to flow down through the first tailings loaded in the vertical column.

8. The method of claim 1 wherein the dryer includes a plurality of separate drying trays.

9. The method of claim 1 wherein the dryer is a rotary dryer having heated gas moving in a countercurrent direction to the second tailings.

10. The method of claim 1 wherein the dryer is a fluidized bed dryer.

11. The method of claim 1 wherein the bitumen ore material includes tar sands.

12. The method of claim 1, wherein the second hydrocarbon solvent vapor is heated to a temperature of about 80° C.

13. A method comprising:

crushing bitumen ore material in a crusher while adding a first quantity of heated first hydrocarbon solvent to the bitumen ore material;

mixing the crushed bitumen ore material with a second quantity of heated first hydrocarbon solvent and forming a first mixture in a first mixing vessel;

separating a first quantity of first hydrocarbon solvent enriched phase from the first mixture; loading the first mixture in a vertical column;

passing a third quantity of heated first hydrocarbon solvent through the first mixture loaded in the a vertical column and forming a second mixture;

collecting, a second quantity of first hydrocarbon solvent enriched phase exiting the vertical column at a bottom end of the vertical column;

passing a second hydrocarbon solvent vapor through the second mixture loaded in the vertical column;

flashing the second mixture loaded in the vertical column and forming tailings; and removing second hydrocarbon solvent from the tailings in a dryer.

14. The method of claim 13, wherein the heated first hydrocarbon solvent includes an aromatic solvent.

15. The method of claim 13, wherein the second hydrocarbon solvent includes a paraffinic solvent.

16. The method of claim 13, wherein the heated first hydrocarbon solvent is at a temperature in the range of from 30 to 60° C.

17. The method of claim 13, wherein the second hydrocarbon solvent vapor is at a temperature of about 80° C. and a pressure of several atmospheres.

18. The method of claim 14, wherein the bitumen ore material is at a temperature of from 0 to 4° C.

* * * * *